US007258167B2

(12) United States Patent
Shammai et al.

(10) Patent No.: US 7,258,167 B2
(45) Date of Patent: Aug. 21, 2007

(54) METHOD AND APPARATUS FOR STORING ENERGY AND MULTIPLYING FORCE TO PRESSURIZE A DOWNHOLE FLUID SAMPLE

(75) Inventors: Michael Shammai, Houston, TX (US); Francisco Galvan Sanchez, Houston, TX (US); Harry Wade Bullock, Montgomery, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/248,734

(22) Filed: Oct. 12, 2005

(65) Prior Publication Data

US 2006/0076144 A1 Apr. 13, 2006

Related U.S. Application Data

(60) Provisional application No. 60/618,378, filed on Oct. 13, 2004.

(51) Int. Cl.
*E21B 49/08* (2006.01)

(52) U.S. Cl. ..... 166/264; 166/162; 73/864.35; 73/864.62

(58) Field of Classification Search ..... 166/264, 166/162; 73/152.23, 152.55, 863, 864.35, 73/864.62; 175/59, 58
See application file for complete search history.

(56) References Cited

U.S. PATENT DOCUMENTS 4,583,595 A 4/1986 Czernichow et al.
4,597,439 A * 7/1986 Meek ..... 166/163
4,633,952 A 1/1987 Ringgenberg
4,721,157 A 1/1988 Berzin
4,766,955 A 8/1988 Petermann
4,856,585 A 8/1989 White et al.
4,860,581 A 8/1989 Zimmerman et al.
4,903,765 A 2/1990 Zunkel
4,936,139 A 6/1990 Zimmerman et al.
4,940,088 A 7/1990 Goldschild
4,994,671 A 2/1991 Safinya et al.
5,009,100 A * 4/1991 Gruber et al. ..... 73/152.28
5,166,747 A 11/1992 Schroeder et al.
5,240,072 A 8/1993 Schultz et al.

(Continued)

FOREIGN PATENT DOCUMENTS

GB 2288618 10/1995

(Continued)

*Primary Examiner*—David Bagnell
*Assistant Examiner*—Daniel P Stephenson
(74) *Attorney, Agent, or Firm*—Madan, Mossman & Sriram, P.C.

(57) ABSTRACT

A method and apparatus store energy in an energy storage medium located in an energy storage chamber. As a sampling tool descends into the borehole, the energy storage medium is pressurized with hydrostatic pressure. A sample is collected in a sample chamber by pumping formation fluid into the sample chamber against hydrostatic pressure. The energy storage medium applies the energy stored in the energy storage medium to the sample through a pressure communication member. A pressure multiplier member increases the pressure applied on the sample by the energy storage medium through the pressure communication member to keep pressure on the sample. A biasing water pressure is applied to the sample at the surface so that the energy storage chamber can be removed from the sample chamber.

41 Claims, 4 Drawing Sheets

U.S. PATENT DOCUMENTS

| | | | | |
|---|---|---|---|---|
| 5,269,180 | A | 12/1993 | Dave et al. | |
| 5,303,775 | A | 4/1994 | Michaels et al. | |
| 5,322,120 | A | 6/1994 | Bøe et al. | |
| 5,329,811 | A | 7/1994 | Schultz et al. | |
| 5,337,822 | A | 8/1994 | Massie et al. | |
| 5,361,839 | A | 11/1994 | Griffith et al. | |
| 5,377,755 | A | 1/1995 | Michaels et al. | |
| 5,609,205 | A | 3/1997 | Massie et al. | |
| 5,662,166 | A | 9/1997 | Shammai | |
| 5,672,819 | A | 9/1997 | Chin et al. | |
| 5,708,220 | A | 1/1998 | Burge | |
| 5,741,962 | A | 4/1998 | Birchak et al. | |
| 5,901,788 | A | 5/1999 | Brown et al. | |
| 5,934,374 | A | 8/1999 | Hrametz | |
| 5,939,717 | A | 8/1999 | Mullins | |
| 5,956,132 | A | 9/1999 | Donzier | |
| 6,065,355 | A | 5/2000 | Schultz | |
| 6,192,984 | B1 * | 2/2001 | Schultz | 166/264 |
| 6,216,782 | B1 * | 4/2001 | Skinner | 166/250.01 |
| 6,467,544 | B1 | 10/2002 | Brown et al. | |
| 6,688,390 | B2 * | 2/2004 | Bolze et al. | 166/264 |
| 7,191,672 | B2 | 3/2007 | Ringgenberg | |
| 2002/0017387 | A1 | 2/2002 | Ringgenberg et al. | |
| 2002/0043371 | A1 | 4/2002 | Howlett et al. | |
| 2002/0060067 | A1 | 5/2002 | Bolze et al. | |
| 2002/0129936 | A1 | 9/2002 | Cernosek | |
| 2003/0066646 | A1 * | 4/2003 | Shammai et al. | 166/264 |
| 2003/0217845 | A1 | 11/2003 | Sherwood et al. | |
| 2004/0000433 | A1 | 1/2004 | Hill et al. | |
| 2004/0020649 | A1 | 2/2004 | Fields | |
| 2004/0055400 | A1 * | 3/2004 | Ringgenberg et al. | 73/864.62 |
| 2004/0099443 | A1 | 5/2004 | Miester et al. | |
| 2004/0129070 | A1 | 7/2004 | Bolze et al. | |
| 2004/0149437 | A1 | 8/2004 | Ringgenberg et al. | |
| 2004/0163808 | A1 | 8/2004 | Ringgenberg et al. | |
| 2004/0173351 | A1 | 9/2004 | Fox et al. | |
| 2004/0216874 | A1 | 11/2004 | Grant et al. | |
| 2004/0221983 | A1 | 11/2004 | Ma et al. | |
| 2004/0261992 | A1 | 12/2004 | Belshaw et al. | |
| 2005/0028973 | A1 | 2/2005 | Paluch et al. | |
| 2005/0028974 | A1 | 2/2005 | Moody et al. | |
| 2005/0082059 | A1 | 4/2005 | Nogueira et al. | |
| 2005/0155760 | A1 | 7/2005 | Hill et al. | |
| 2005/0194134 | A1 | 9/2005 | McGregor et al. | |
| 2005/0279499 | A1 | 12/2005 | Tarvin et al. | |
| 2005/0284629 | A1 | 12/2005 | Reid et al. | |
| 2006/0021796 | A1 | 2/2006 | Moran et al. | |

FOREIGN PATENT DOCUMENTS

| | | |
|---|---|---|
| GB | 2396648 | 3/2003 |

* cited by examiner

METHOD AND APPARATUS FOR STORING ENERGY AND MULTIPLYING FORCE TO PRESSURIZE A DOWNHOLE FLUID SAMPLE

CROSS REFERENCE TO RELATED APPLICATIONS

This patent application claims priority form U.S. provisional patent application Ser. No. 60/618,378 filed on Oct. 13, 2004 entitled A Method and Apparatus For Storing Energy and Multiplying Force to Pressurize A Down Hole Fluid Sample, Shammai et al., which is hereby incorporated by reference in its entirety.

BACKGROUND OF THE INVENTION

1. Field of the Invention

The present invention relates generally to the field of downhole sampling analysis and in particular to storing energy in a storage medium to pressurize a formation fluid sample at down hole pressure and temperature to retrieve the sample to the surface without significant pressure loss on the sample due to a reduction in temperature.

2. Background Information

Earth formation fluids in a hydrocarbon producing well typically contain a mixture of oil, gas, and water. The pressure, temperature and volume of the formation fluids control the phase relation of these constituents. In a subsurface formation, formation fluid often entrains gas within oil when the pressure is above the bubble point pressure. When the pressure on a formation fluid sample is reduced, the entrained or dissolved gaseous compounds separate from the liquid phase sample. The accurate measurement of pressure, temperature, and formation fluid sample composition from a particular well affects the commercial viability for producing fluids available from the well. The measurement data also provides information regarding procedures for maximizing the completion and production of the hydrocarbon reservoir associated with the hydrocarbon producing well.

Downhole fluid sampling is well known in the art. U.S. Pat. No. 6,467,544 to Brown, et al. describes a sample chamber having a slidably disposed piston to define a sample cavity on one side of the piston and a buffer cavity on the other side of the piston. U.S. Pat. No. 5,361,839 to Griffith et al. (1993) discloses a transducer for generating an output representative of fluid sample characteristics downhole in a wellbore. U.S. Pat. No. 5,329,811 to Schultz et al. (1994) discloses an apparatus and method for assessing pressure and volume data for a downhole well fluid sample.

Other techniques enable capture of a formation fluid sample for retrieval to the surface. U.S. Pat. No. 4,583,595 to Czenichow et al. (1986) discloses a piston actuated mechanism for capturing a formation fluid sample. U.S. Pat. No. 4,721,157 to Berzin (1988) discloses a shifting valve sleeve for capturing a formation fluid sample in a chamber. U.S. Pat. No. 4,766,955 to Petermann (1988) discloses a piston engaged with a control valve for capturing a formation fluid sample, and U.S. Pat. No. 4,903,765 to Zunkel (1990) discloses a time-delayed formation fluid sampler. U.S. Pat. No. 5,009,100 to Gruber et al. (1991) discloses a wireline sampler for collecting a formation fluid sample from a selected wellbore depth. U.S. Pat. No. 5,240,072 to Schultz et al. (1993) discloses a multiple sample annulus pressure responsive sampler for permitting formation fluid sample collection at different time and depth intervals, and U.S. Pat. No. 5,322,120 to Be et al. (1994) discloses an electrically actuated hydraulic system for collecting formation fluid samples deep in a wellbore.

Temperatures downhole in a deep wellbore often exceed 300 degrees F. When a hot formation fluid sample is retrieved to the surface at ambient temperature, the resulting drop in temperature causes the formation fluid sample to contract. If the volume of the sample is unchanged, contraction due to temperature reduction substantially reduces the pressure on the sample. A pressure drop in the sample causes undesirable changes in the formation fluid sample characteristics, and can allow phase separation to occur between the formation fluid and gases entrained within the formation fluid sample. Phase separation significantly changes the formation fluid sample characteristics and reduces the ability to properly evaluate the properties of the formation fluid sample.

To overcome this limitation, various techniques have been developed to maintain pressure of the formation fluid sample at a high pressure while retrieving the sample to the surface. U.S. Pat. No. 5,337,822 to Massie et al. (1994) discloses an apparatus that pressurized a formation fluid sample with a hydraulically driven piston powered by a high-pressure gas. Similarly, U.S. Pat. No. 5,662,166 to Shammai (1997) utilizes a pressurized gas to pressurize the formation fluid sample. U.S. Pat. Nos. 5,303,775 (1994) and 5,377,755 (1995) to Michaels et al. disclose a bi-directional, positive displacement pump for increasing the formation fluid sample pressure above the bubble point so that subsequent cooling does not reduce the fluid pressure below the bubble point. These known methods compensate for expected pressure losses on the sample by exerting additional pressure on the formation fluid sample.

The additional pressure is supplied by either a pump or a pressurized nitrogen gas. Thus, the over pressure supplied to the formation fluid sample in the above related sampling techniques is limited by the capacity of the pump or initial pressure of the gas to maintain the sample at single phase conditions (above the bubble point). In some cases, it may be desirable to provide additional pressure on the sample that might exceed the capacity of the sampling pump. Thus there is a need for a method and apparatus that supplies additional pressure on a formation fluid sample that exceeds the pumping capacity of the sampling pump.

The provision of additional pressure from a gas typically requires pumping high pressure fluid or gas into a chamber in a sampling tool at the surface. These pressures can reach 10,000–15,000 pounds per square inch. Such high pressures should be treated with sufficient caution to avoid risk to human life. Thus, there is a need for a gas pressurization system that does not require pumping fluids or gases to high pressures, such as 10,000–15,000 pounds per square inch, at the surface to avoid the risk associated with such high pressures. Typically, the pressurizing modules remain affixed to the sample tank to maintain the sample at or above the in- situ formation pressure at the sampling depth. Thus, there is a need for a removable pressurizing module.

SUMMARY OF THE INVENTION

The present invention provides a method and apparatus for pressurizing an object material such as a formation fluid sample. The apparatus of the present invention provides an object volume which contains an object material and an energy storage volume which contains an energy storage material also referred to as an energy storage medium. The energy storage material or medium provides a pressure which pressurizes the object material. The object material is typically a formation fluid sample. The pressure from the energy storage medium in the energy storage volume is transferred to the object volume through a pressure communication member which provides pressure communication between the object material and the energy storage medium. A force multiplier member is provided which multiplies a force generated by the energy storage medium and applies the multiplied force to the object material (e.g., a formation fluid sample) through the pressure communication member. The energy storage medium stores the pressure applied by the hydrostatic pressure downhole during sampling and applies the stored pressure to the sample after hydrostatic pressure is reduced as the down hole sampling tool ascends to the surface from downhole.

The method and apparatus of the present invention stores energy in an energy storage medium such as a fluid or a gas cushion. The pressurized energy storage medium applies the stored energy to the sample through a hydraulic multiplier to pressurize a formation fluid sample. The hydraulic multiplier or pressure multiplier applies a multiple of the sampling depth hydrostatic pressure to the sample. A compressible storage medium, (e.g., a gas or fluid) stored in a gas chamber associated with a sampling tool is pressurized to a relatively safe initial pressure at the surface. As the sampling tool descends into the borehole an energy storage piston in pressure communication with the energy with the energy storage medium is exposed to hydrostatic pressure of the drilling fluid present in the borehole. The hydrostatic pressure on the energy storage piston pressurizes the energy storage medium.

A sample is collected in the sample tank by pumping formation fluid into the sample tank against a sample chamber piston biased by hydrostatic pressure. After sampling, the sample chamber piston and the energy storage piston are then placed in pressure communication with each other using a pressure communication member. The pressure communication member can be a hydraulic or mechanical link between the two pistons. As the sample tank returns to the surface, hydrostatic pressure from well bore fluid flowing into the tool is gradually released from the tool and removed from pressurizing the sample and the energy storage piston. The energy storage piston maintains pressure on the sample via the stored pressure in the energy storage medium, using a multiplier effect and a pressure communication member. The removal of hydrostatic pressure from the energy storage piston allows the pressurized energy storage medium to exert a pressure on the sample through the pressure communication with the sampling piston.

A force multiplier effect is accomplished by applying the stored energy in the energy storage medium to the sample using a larger piston on the energy storage medium and a smaller piston on the sample. The ratio between the energy storage piston surface area and the sample piston surface area multiples the pressure and over pressurizes the sample. The multiplier effect is proportional to the ratio of the energy storage piston surface area to the sample chamber piston surface area. As the energy storage piston surface area is larger than the sample chamber piston surface area, every pound of force exerted by the energy storage medium is multiplied by the multiplier effect and applied to the sample through the sample chamber piston. Upon return to the surface, a biasing water pressure is applied to the underside of the sample chamber piston so that the energy storage chamber can be removed from the sample tank prior to transporting the sample tank to a laboratory for testing of the sample.

An exemplary method according to the present invention stores energy in a storage medium and applies the stored energy to a sample through a multiplier member. The method further includes pressurizing the sample at the surface to enable removal of the pressure storage medium from the sample. In one aspect of the invention an apparatus is provided for pressurizing a sample down hole having a sample chamber that contains the sample, the sample chamber having a moveable sample chamber piston in pressure communication with hydrostatic pressure on a lower side of the sample chamber piston and in pressure communication with the sample on an upper side of the sample chamber piston. The apparatus provides an energy storage chamber containing an energy storage medium in pressure communication with the sample chamber, the energy storage chamber having an energy storage piston. A connecting pressure communication member is positioned between the sample chamber piston and the energy storage piston.

In another aspect of the invention, a system is provided having a downhole tool having a pump that transfers a sample into a sample chamber against a moveable sample chamber piston in pressure communication with hydrostatic pressure. The sample chamber piston is in pressure communication the sample in the sample chamber. An energy storage chamber containing an energy storage medium in pressure communication with the sample in the sample chamber is provided. The energy storage chamber has an energy storage piston and a connecting member between the sample chamber piston and the energy storage piston.

In another aspect of the invention a method is provided wherein the sample is pumped into a sample chamber against a hydrostatic pressure. The energy storage medium is pressurized with the hydrostatic pressure. The sample chamber and the energy storage medium are placed in pressure communication.

Examples of certain features of the invention have been summarized here rather broadly in order that the detailed description thereof that follows may be better understood and in order that the contributions they represent to the art may be appreciated. There are, of course, additional features of the invention that will be described hereinafter.

BRIEF DESCRIPTION OF THE FIGURES

For a detailed understanding of the present invention, references should be made to the following detailed description of the exemplary embodiment, taken in conjunction with the accompanying drawings, in which like elements have been given like numerals, wherein.

DETAILED DESCRIPTION OF THE INVENTION

Figure 1:
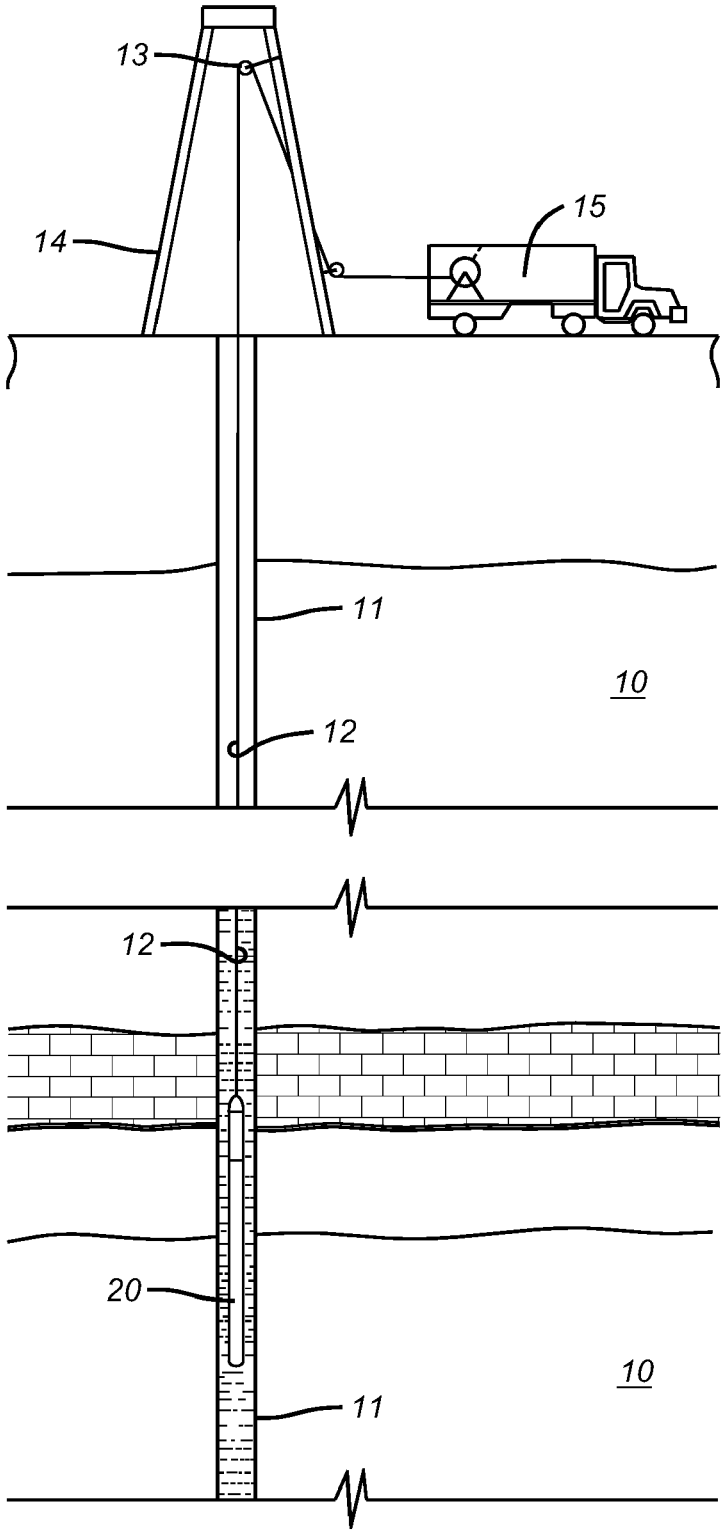
FIG. 1 is a schematic diagram of an earth section illustrating the invention in an exemplary operating environment.

FIG. 1 schematically represents a cross-section of earth 10 along the depth of a wellbore 11 penetrating the Earth. Usually, the wellbore is at least partially filled with a mixture of liquids including water, drilling fluid, and formation fluids that are indigenous to the earth formations penetrated by the wellbore. Hereinafter, such fluid mixtures are referred to as "wellbore fluids." Suspended within the wellbore 11 at the bottom end of a wireline 12 is a formation fluid sampling tool 20. The wireline 12 is often carried over a pulley 13 supported by a derrick 14. Wireline deployment and retrieval is performed by a powered winch may be carried by a service truck 15.

Figure 2:
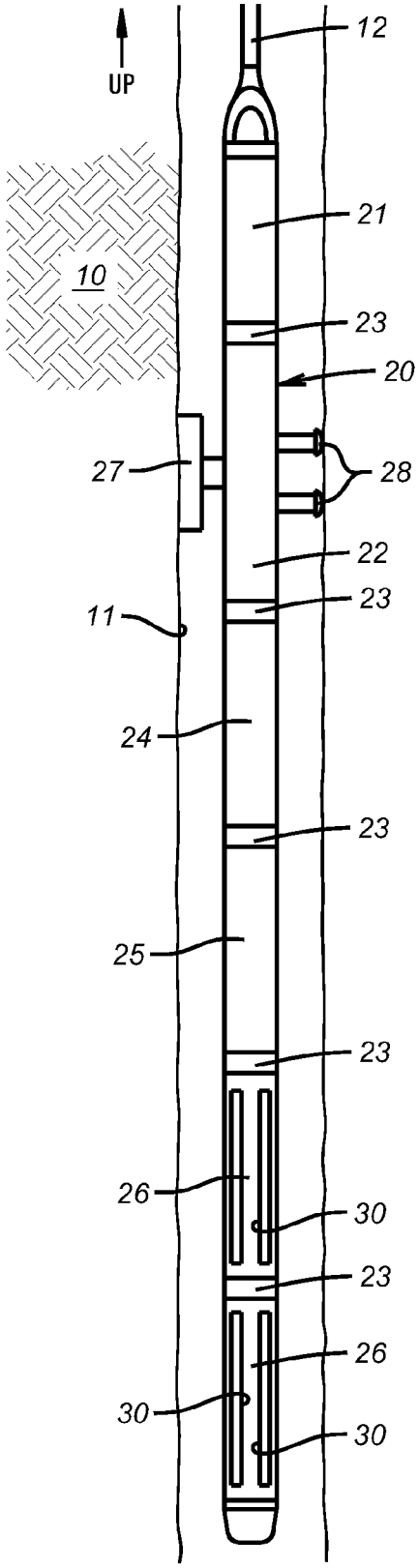
FIG. 2 is a schematic of the apparatus of the invention in an exemplary operative assembly with cooperatively supporting tools.

Pursuant to the present invention, an exemplary embodiment of the sampling tool 20 is schematically illustrated in FIG. 2. In the present example, the sampling tool 20 comprises a serial assembly of several tool segments that are joined end-to-end by the threaded sleeves of mutual compression unions 23. An assembly of tool segments appropriate for the present invention may include a hydraulic power unit 21 and a formation fluid extractor 22. A large displacement volume motor/pump unit 24 is provided for line purging. Below the large volume pump 24 is a similar motor/pump unit 25 having a smaller displacement volume that is quantitatively monitored. Ordinarily, one or more sample tank magazine sections 26 are assembled below the small volume pump 24. Each magazine section 26 may have three or more fluid sample tanks 30.

The formation fluid extractor 22 contains an extensible suction probe 27 that is opposed by bore wall feet 28. Both, the suction probe 27 and the opposing feet 28 are hydraulically extensible to firmly engage the wellbore walls. Construction and operational details of the fluid extraction tool 22 are more expansively described by U.S. Pat. No. 5,303,775, the specification of which is incorporated herewith.

Figure 3:
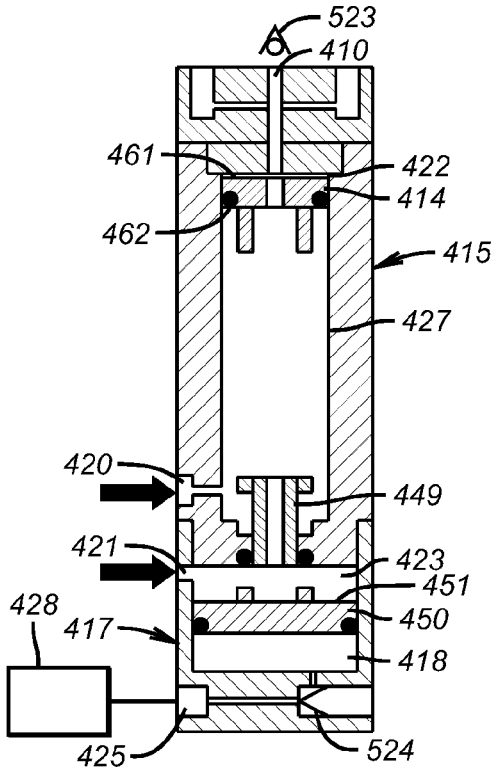
FIG. 3 is an illustration of an exemplary sample chamber associated with an energy storage chamber in an exemplary embodiment of the present invention.

Turning now to FIG. 3, sample tank 415 is shown attached to an energy storage apparatus 417. The apparatus of FIG. 3 includes a sample chamber 422, and a sample chamber piston 414. The top side 461 of the sample chamber piston 414 and the upper portion of the sample chamber 422 are in fluid communication with formation fluid in the flow line 410. A check valve 523 is provided in flow line 410 to allow fluid into by not out of the sample tank via flow line 410. Pump 25 (FIG. 2) withdraws fluid from the formation and pumps the formation fluid into the sample chamber 422 via flow line 410. Hydrostatic pressure is applied to the lower side 427 of the sample piston 414 via orifice 420 which is open to the borehole. Thus, the formation fluid may be pumped from the formation into the sample chamber 422 against the hydrostatic pressure of the well bore fluid present in the sample biasing chamber 427.

The apparatus of FIG. 3 further includes an energy biasing chamber 423 and an energy storage piston 450. The top side 451 of the energy storage piston 450 is biased with the hydrostatic pressure from the energy biasing chamber 423 which contains wellbore fluid which enters the energy biasing chamber 421. The well bore fluid enters the energy biasing chamber 423 via orifice 421 which is open to the borehole. A surface pump 428 pumps storage medium such as a gas or liquid through an orifice 425 into the energy storage chamber 418 at a relatively safe surface pressure. The storage medium may be any compressible fluid or gas. An initial pressure may be applied at the surface to the storage medium at a safe surface pressure. In one aspect of the invention, nitrogen gas may be pumped into the storage chamber 418 at a relatively safe pressure, such as 3000 pounds per square inch. During sampling, (i.e., when the formation fluid is pumped into the chamber 422) the sample chamber piston 414 travels along inside of the sample chamber 422 until it makes contact with the pressure communication member 449. Pressure communication member 449 will in turn make contact with the energy storage piston 450 upon further sample overpressurizing and associated displacement of the sample chamber piston 414.

The initial surface pressure in the energy storage chamber is calculated based on dimensions for the sample chamber piston 414 face surface area adjacent the formation fluid sample and energy storage piston 450 face surface area adjacent the energy storage medium and the dimensions and physical characteristics of the pressure communication member 449 to ensure that the sample chamber piston 414 and energy storage piston 450 are in pressure communication via the pressure communication member 449 before ascent to the surface from the borehole.

Maintaining pressure communication through the pressure communication member 449 between the sample chamber piston 414 and energy storage piston 450 ensures efficient force transfer from the energy storage medium to the energy storage piston to the sample chamber piston thereby pressurizing the sample in the sample chamber. The initial energy storage medium pressure is also calculated so that the sample and energy storage medium maintain pressure communication during ascent of the sampling tool from the borehole. As the sampling tool is lowered into the borehole, drilling fluid enters the tool from the borehole through orifice 420 and orifice 421 and biases the bottom side 462 of the sample chamber piston 414 and the top side 451 of the energy storage piston with the hydrostatic pressure. As the tool 20 descends into the borehole 11 the hydrostatic pressure increases on the bottom side 462 of the sample chamber piston 414 and the top side 451 of the energy storage piston. The pressure on the top side 451 of the energy storage piston pressurizes the energy storage medium (e.g., nitrogen gas) in the energy storage chamber to the hydrostatic pressure at the current depth of the tool downhole. The ratio of the energy storage piston face surface area to the sample chamber piston face surface area is calculated to maintain a multiple of the hydrostatic pressure (stored in the energy storage medium from the well bore fluid) on the sample in the sample chamber after reduction and removal of hydrostatic pressure from well bore fluid on bottom side 462 of the sample chamber piston 414 and on the top side 451 of the energy storage piston due to the removal of the tool from downhole hydrostatic pressure. The pressure on the energy storage medium and the formation fluid sample is also reduced by the reduction of temperature on the energy storage medium as the tool ascends to the surface.

Figure 4:
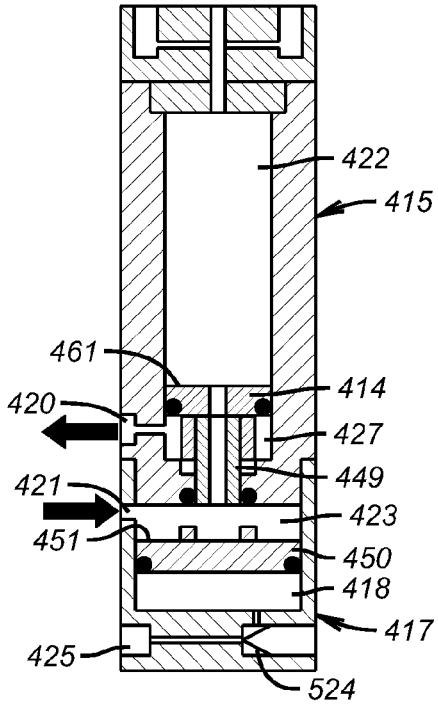
FIG. 4 is an illustration of an exemplary apparatus in which a sample fills the sample chamber and displaces drilling fluid from the sample chamber moving the sample piston into pressure communication with a connecting member.

As shown in FIG. 4, as the formation fluid is pumped through the flow line 410 and into the sample chamber 422, the volume of the sample chamber 422 above the sample chamber piston 414 expands as the sample chamber piston 414 is displaced by the formation fluid filling the sample chamber 422 above the sample chamber piston 414. As the formation fluid flows into sample chamber 422 the displaced sample chamber piston 414 expunges the drilling fluid out of the sample biasing chamber 427 to the borehole via the orifice 420.

Figure 5:
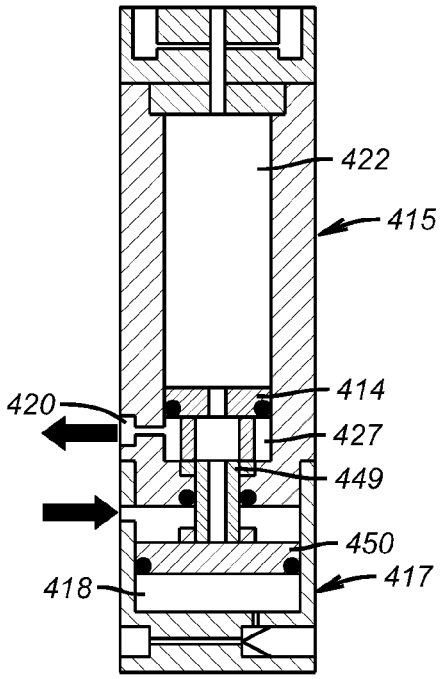
FIG. 5 is an illustration of an exemplary apparatus in which a sample fills a sample chamber and displaces drilling fluid from the sample chamber moving a sample piston into pressure communication with the connecting member (mechanical or hydraulic) and the energy storage chamber.

As shown in FIG. 5, sample chamber piston 414 travels down to abut pressure communication member 449 (shown in the present example as a connecting rod) which abuts the energy storage chamber piston 450 placing the sample chamber 422 in pressure communication with the energy storage chamber 418. For example, at a particular depth where the hydrostatic pressure is 15,000 psi, the sample chamber 422, the energy biasing chamber 423, the sample biasing chamber 427, and the energy storage chamber 418 are all pressurized to at least the hydrostatic pressure, that is, 15,000 psi. The sample is over pressurized above hydrostatic pressure to overcome the hydrostatic pressure opposing the sample chamber piston during filling of the sample chamber 422.

At the end of pumping the sample into the sample chamber 422 (i.e., pumping formation fluid into the sample chamber), the sample chamber 422 and the energy storage chamber 418 are in pressure communication with each other through the pressure communication member 449. As the sampling tool is removed from the borehole and ascends to the surface, hydrostatic pressure decreases as described above. As the hydrostatic pressure decreases, the drilling mud is forced out of the energy biasing chamber 423 through the orifice 421 by the greater pressure applied from the force multiplying pistons surface areas, the pressure communication member and the energy stored in the energy storage chamber 418. The pressure in the energy storage chamber 418 which was pressurized to hydrostatic at the sampling depth, forces the drilling fluid out of the energy biasing chamber 423 through the orifice 421. The sample chamber 422 and the energy storage chamber 418 are in pressure communication as the hydrostatic pressure in the energy biasing chamber is reduced to the atmospheric conditions at the surface. The energy storage medium (in the present example, a nitrogen gas charge) applies stored hydrostatic pressure to the formation fluid sample contained in sample chamber 422.

Figure 6:
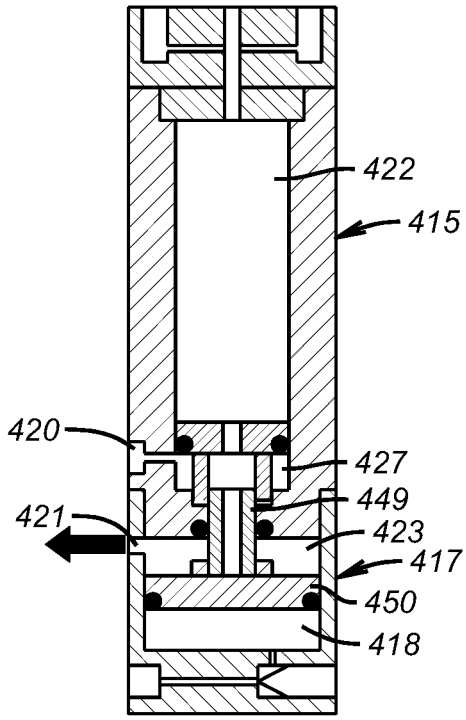
FIG. 6 is an illustration of an exemplary sample chamber in which the sample tank has been brought to the surface and hydrostatic pressure has been relieved from behind the energy storage piston allowing the pressurized energy storage medium to apply a multiplied force to the sample in the sample tank through the pressure communication member.

FIG. 6 is an illustration of the exemplary sample tank 415 in which the sample tank is brought to the surface and the hydrostatic pressure is relieved from the energy biasing chamber 423 behind the energy storage piston 450 and the sample bias chamber 427 behind the sample chamber piston 414. After sampling is completed, the sample chamber 422 and the energy storage chamber 418 form two closed systems in pressure communication with each other through the pressure communication member 449. The two closed systems are both at substantially hydrostatic pressure or slightly higher as the sample chamber had to be over pressurized to force sampling fluid into the sample chamber against the bias of the hydrostatic pressure under the sample chamber piston. As the well bore fluid exits the energy bias chamber 423 and the sample bias chamber 427, the pressurized energy storage medium is no longer opposed by the hydrostatic pressure at the sampling depth, and thus applies a multiple of the stored hydrostatic pressure at sampling depth to the sample through the connecting member 449 (in the present embodiment a rod). That is, as the hydrostatic pressure in the energy biasing chamber 423 decreases to a pressure below the pressure to which the energy storage medium was charged, the energy storage chamber which was pressurized to the hydrostatic pressure at sampling depth exerts a force on the sample chamber piston 414 through the pressure communication member 449 that is proportional to a multiple of the stored hydrostatic pressure on the energy medium in the energy storage chamber 418 at the sampling depth. The pressure multiplier effect is caused by the disparity between the larger surface area of the energy storage piston 450 and the smaller surface area of the sample chamber piston 414.

Any ratio of the piston surface areas may be used to achieve the desired pressure multiplier effect. For example, assume that the energy storage medium has been pressurized to a pressure of 15,000 psi. If the ratio of the energy storage piston surface area to the sample chamber piston surface area is 2 to 1, then the energy storage piston 450 has a surface area twice as large as the surface area of the sampling piston 414. In this case, a pressure of 15,000 psi on the energy storage piston (exerted on the energy storage medium by 15,000 psi hydrostatic pressure at sampling depth) exerts a pressure equivalent to 30,000 psi on the sample due to the smaller size of the sample chamber piston 414. That is, the pressure in the energy storage medium is multiplied by the ratio of the surface area of the energy storage piston to the sample chamber piston. Thus, in the current example of the invention the formation fluid sample in the sample chamber can be pressurized to a pressure of two times the hydrostatic at the sampling depth when the ratio of the energy storage piston 450 surface area to the sample chamber piston 414 surface area is 2 to 1, creating a multiplier effect of 2. Thus, when cooling at the surface causes the pressure in the energy storage chamber to drop below hydrostatic at sampling depth (e.g., 15,000 psi) the pressure multiplier effect keeps the sample pressurized well above hydrostatic (e.g., 15,000 psi). That is, assuming a 2.5 to 1 pressure multiplier, if the energy storage medium pressure drops to 10,000 psi, the pressure multiplier still applies a pressure of 25,000 psi on the sample.

Figure 7:
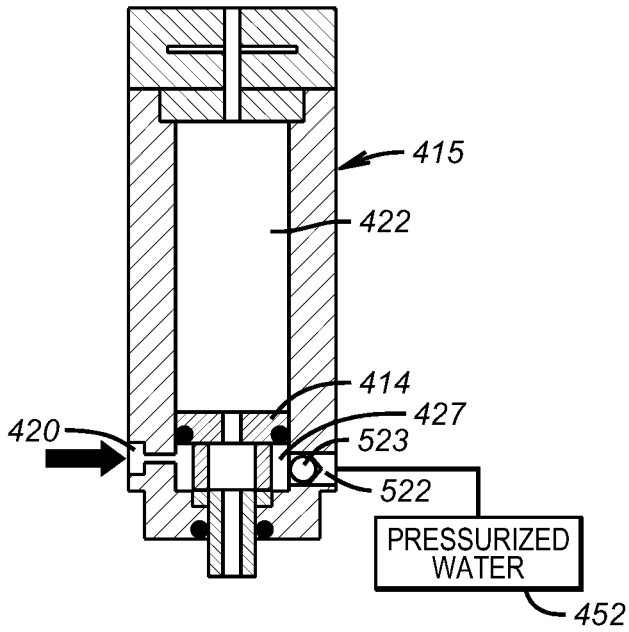
FIG. 7 is an illustration of an exemplary apparatus in which a pressurizing fluid is pumped behind the sample chamber piston to maintain pressure on the sample chamber and to enable removal of the energy storage chamber.

Turning now to FIG. 7, at the surface, a water pump may be connected to an orifice 522 equipped with a check valve 523 to apply pressure to the back side 462 of the sample chamber piston 414 and to pressurize the sample and to wash out the sample biasing chamber 427. Orifice 420 is plugged to maintain the pressure on the sample. The energy storage apparatus 417 can then be removed from the sample tank 415 without losing pressure on the sample in the sample chamber 422. Orifice 420 is then plugged to pressurize the formation fluid sample in the sample chamber 422 with a high pressure fluid, such as water, in the sample biasing chamber 427 to prevent losing sample pressure during the transfer of the sample chamber. The water pressure from the surface water pump 452 keeps the sample under pressure to prevent flashing of the sample inside of the sample chamber 422 during transfer. In surface operations, as shown in FIG. 7, the sample tank assembly 415 is removed from a sample tank carrier. The sample tank 415 may then be transported without the energy storage chamber apparatus 417.

While the foregoing disclosure is directed to the exemplary embodiments of the invention various modifications will be apparent to those skilled in the art. It is intended that all variations within the scope of the appended claims be embraced by the foregoing disclosure. Examples of the more important features of the invention have been summarized rather broadly in order that the detailed description thereof that follows may be better understood, and in order that the contributions to the art may be appreciated.

What is claimed is:

1. An apparatus for pressurizing a sample downhole comprising:

a sample chamber that contains the sample, the sample chamber having a moveable sample chamber piston in pressure communication with hydrostatic pressure on a lower side of the sample chamber piston and in pressure communication with the sample on an upper side of the sample chamber piston;

an energy storage chamber containing an energy storage medium, the energy storage chamber having an energy storage piston in pressure communication with the sample chamber; and a pressure communication member posited between the sample chamber piston and the energy storage piston.

2. The apparatus of claim 1, further comprising:

an energy bias chamber that applies hydrostatic pressure to the energy storage medium.

3. The apparatus of claim 1, further comprising:

a sample bias chamber that applies hydrostatic pressure to the sample.

4. The apparatus of claim 1, wherein the energy storage piston has a surface area different than a surface area of the sample chamber piston.

5. The apparatus of claim 1, wherein the energy storage piston has a surface area larger than a surface area of the sample chamber piston.

6. The apparatus of claim 1, wherein the sample comprises at least one of the set consisting of a fluid and a gas.

7. The apparatus of claim 1, further comprising:

a pressure chamber in pressure communication with the sample which accepts a pressurizing fluid to pressurize the sample chamber to enable removal of the energy storage chamber from pressure communication with the sample chamber.

8. A system for pressurizing a sample downhole comprising:

a downhole tool having a pump that transfers the sample into a sample chamber against a moveable sample chamber piston, wherein the sample chamber piston is in pressure communication with hydrostatic pressure on a lower side of the sample chamber piston and in pressure communication with the sample in the sample chamber on an upper side of the sample chamber piston;

an energy storage chamber containing an energy storage medium, the energy storage chamber having an energy storage piston in pressure communication with the sample in the sample chamber; and a pressure communication member posited between the sample chamber piston and the energy storage piston.

9. The system of claim 8, further comprising:

an energy bias chamber that applies hydrostatic pressure to the energy storage medium.

10. The system of claim 8, further comprising:

a sample bias chamber that applies hydrostatic pressure to the sample.

11. The system of claim 8, wherein the energy storage piston has a surface area different than a surface area of the sample piston.

12. The system of claim 8, wherein the energy storage piston has a surface area larger than a surface area of the sample chamber piston.

13. The system of claim 8, wherein the sample comprises at least one of the set consisting of a fluid and a gas.

14. The system of claim 8, further comprising:

a pressure chamber which accepts a pressurizing fluid to pressurize the sample chamber to enable removal of the energy storage chamber from pressure communication with the sample chamber.

15. A method for pressurizing a sample downhole comprising:

(a) pressurizing an energy storage medium with a hydrostatic pressure;

(b) pumping the sample into a sample chamber against the hydrostatic pressure, the sample chamber having a first movable member; and (c) communicating pressure between the energy storage medium and the sample chamber using a communication member and the first movable member.

16. The method of claim 15, further comprising:

pressurizing the energy storage medium to an initial pressure.

17. The method of claim 15, further comprising:

pressurizing the sample chamber with hydrostatic pressure.

18. The method of claim 15, further comprising:

Pressurizing the sample chamber with a multiple of hydrostatic pressure.

19. The method of claim 15, further comprising:

removing the hydrostatic pressure from the sample and the energy storage medium; and applying a multiple of pressure stored in the energy storage medium to the sample in the sample chamber.

20. The method of claim 15 wherein the energy storage media is a compressible fluid.

21. The method of claim 15 wherein establishing the pressure communication further comprises establishing a mechanical link between the sample and the energy storage medium.

22. The method of claim 15 further comprising:

maintaining pressure on the sample and the energy storage medium at the hydrostatic pressure at a first depth in a wellbore;

applying the pressure greater than the hydrostatic pressure to the sample at a second depth in the wellbore.

23. The method of claim 22 wherein the pressure greater than the hydrostatic pressure is a multiplier of the hydrostatic pressure.

24. The method of claim 23 further comprising:

defining the multiplier by a ratio of surface areas associated with the sample chamber and an energy storage chamber receiving the energy storage medium.

25. The method of claim 15 further comprising pressurizing the sample with the pressure in the energy storage medium while retrieving the sample to the surface.

26. An apparatus for pressurizing a sample downhole, comprising:

(a) a sample chamber containing the sample, the sample chamber having a moveable member in pressure communication with hydrostatic pressure on a first side and in pressure communication with the sample on a second side;

(b) an energy storage chamber having a piston; and (c) a pressure communication member posited between the moveable member and the piston.

27. The apparatus of claim 26, wherein the piston has a first side exposed to hydrostatic pressure and a second side exposed to an energy storage medium.

28. The apparatus of claim 26, further comprising:

a sample bias chamber that applies hydrostatic pressure to the sample.

29. The apparatus of claim 26, wherein the piston has a surface area different than a surface area of the moveable member.

30. The apparatus of claim 26, wherein the piston has a surface area larger than a surface area of the moveable member.

31. The apparatus of claim 26, wherein the sample comprises at least one of a (i) fluid, (ii) a liquid, and (iii) a gas.

32. The apparatus of claim 26, further comprising:

a pressure chamber in pressure communication with the sample which accepts a pressurizing fluid to pressurize the sample chamber to enable removal of the energy storage chamber from pressure communication with the sample chamber.

33. The apparatus of claim 26, further comprising:

a downhole tool having a pump that transfers the sample into the sample chamber against the moveable member.

34. The apparatus of claim 26, further comprising:

an energy storage medium in the energy bias chamber.

35. The apparatus of claim 26, wherein the pressure communication member moves independent of one of (i) the moveable member, and (ii) the piston.

36. A system for pressurizing a sample in a wellbore, comprising:

(a) a derrick positioned over the wellbore;

(b) a sampling tool suspended within the wellbore from the derrick;

(c) a tool segment associated with the sampling tool, the tool segment including:

(i) a sample chamber that contains the sample, the sample chamber having a moveable member in pressure communication with hydrostatic pressure on a first side and in pressure communication with the sample on a second side;

(ii) an energy storage chamber having a piston; and (iii) a pressure communication member posited between the moveable member and the piston.

37. The system of claim 36 further comprising fluid extractor extracting a fluid from a formation, a portion of which comprises the sample.

38. The system of claim 36 further comprising a pump extracting fluid from a formation and pumping the extracted fluid into the sample chamber.

39. The system of claim 36 further comprising a second pump applying pressure to a first side of the piston.

40. The system of claim 36 wherein the energy storage piston is removable from the sample chamber.

41. The system of claim 36 further comprising a wire line coupled to the sampling tool.

* * * * *